United States Patent [19]

Elrick

[11] Patent Number: 4,544,079

[45] Date of Patent: Oct. 1, 1985

[54] OPENER STRUCTURE FOR A CONTAINER

[75] Inventor: Edwin Elrick, P.O. Box 358, Black's Harbour, New Brunswick, Canada, E0G 1H0

[73] Assignees: Edwin Elrick, Blacks Harbour; David L. Lockhart, Fairville; Alfred Hunt, Winona, all of Canada

[21] Appl. No.: 664,378

[22] Filed: Oct. 24, 1984

[51] Int. Cl.[4] ..... B65D 17/42

[52] U.S. Cl. ..... 220/277

[58] Field of Search ..... 220/267, 277

[56] References Cited

U.S. PATENT DOCUMENTS

| | | | |
|---|---|---|---|
| 1,872,585 | 8/1932 | Hegenberger | 220/277 |
| 3,250,424 | 5/1966 | Martin | 220/277 |
| 3,826,401 | 7/1974 | Zundel | 220/277 |
| 4,047,634 | 9/1977 | McGeehin et al. | 220/277 |

*Primary Examiner*—George T. Hall

*Attorney, Agent, or Firm*—Sim & McBurney

[57] ABSTRACT

An opener structure for a container includes a slidable plate juxtaposed against an external wall of the container. Retainer devices such as rivets retain the plate against the wall but permit relative sliding between the wall and the plate. A resilient punch supported from the plate rests on a shelf defined by the wall. A region of weakness lies adjacent the shelf so that if the plate slides away from the shelf, the punch will pierce the line of weakness and rupture it. A lever is provided to cause the plate to slide away from the shelf.

8 Claims, 3 Drawing Figures

OPENER STRUCTURE FOR A CONTAINER

This invention relates generally to structure by which containers such as cans and the like may be readily opened manually, without requiring a can opener or similar instrument. More particularly, this invention relates to an opener structure for a container, the construction of which is such as to allow a person with less than normal strength in the hand to open the container readily.

BACKGROUND OF THIS INVENTION

The prior art contains numerous quick-opening container structures, many of which include pull-up rings adapted to place pressure on a line of weakness and rupture the same, following which an entire portion of a wall of the container can be pulled away utilizing the ring.

Other approaches to the problem have also been attempted. Exemplary are Canadian Pat. No. 733,703, issued May 10, 1966 to L. Fried et al., and Canadian Pat. No. 345,588, issued Oct. 30, 1934 to G. D. McNeill.

However none of the prior art has addressed the necessity for providing a special structure that will allow persons with less than normal hand strength to open a can or other container.

GENERAL DESCRIPTION OF THIS INVENTION

In view of the foregoing discussion, it is an object of an aspect of this invention to provide an opener structure for a container, which is such as to be readily manipulable by a person with minimal strength in the hand.

More particularly, this invention provides, in combination, a container body including a wall intended to be opened, a slidable plate juxtaposed against said wall externally of the container body, retention means retaining said plate against said wall while permitting relative sliding between them, a resilient punch supported by the plate and having a piercing edge biased toward the wall, the punch resting on a shelf-like portion of the wall in biased condition, the wall having a region of weakness adjacent the said shelf-like portion such that if the plate slides away from the shelf-like portion thus drawing the punch off the portion, the piercing edge of the punch can strike the region of weakness and rupture the same, and means for causing the plate to slide away from said shelf-like portion.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
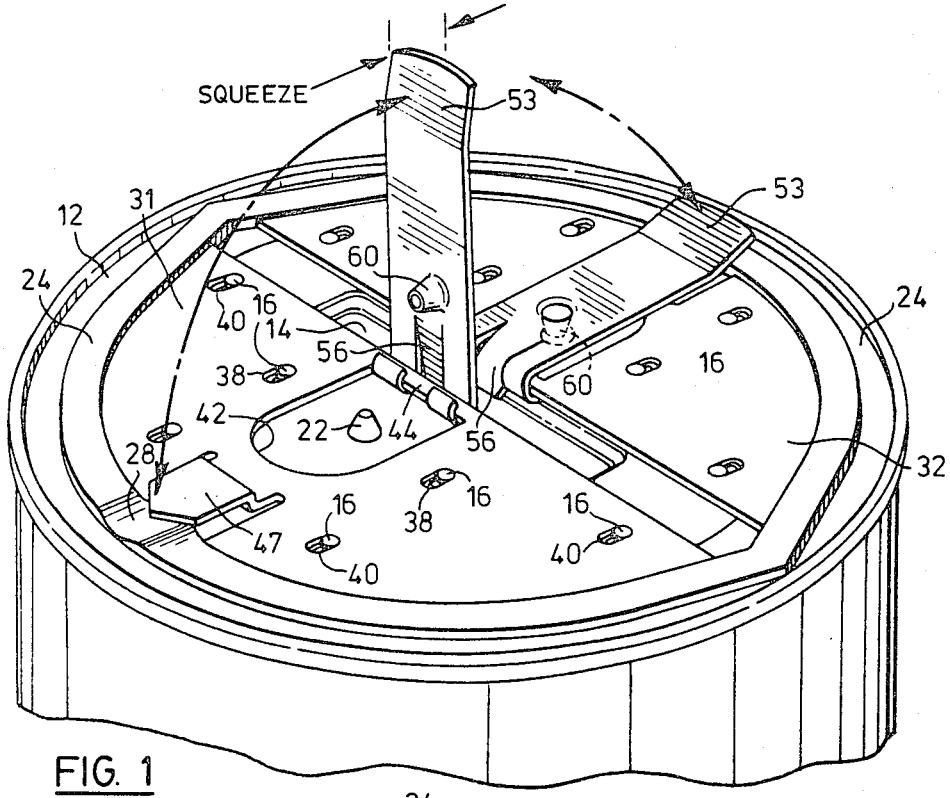
FIG. 1 is a perspective view of a can end, showing the opening structure according to this invention.
Figure 3:
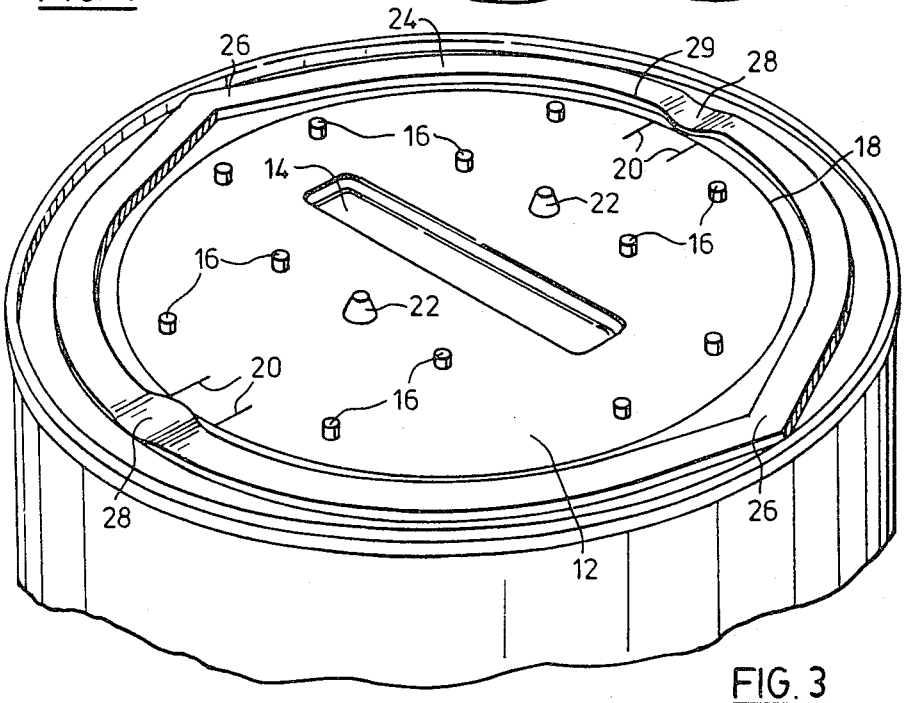
FIG. 3 is a perspective view of the top wall of a can or similar container with the plates removed.

Attention is first directed to FIG. 1, showing a container body 10 having an upper circular wall 12 which is intended to be opened by the structure of this invention. As best seen in FIG. 3, the wall 12 has a central depression 14 and has a plurality of distributed upstanding rivets 16 which are attached to the wall. The depression 14 is elongated and lies substantially on a diameter of the wall 12, and the rivets 16 are distributed to either side of the depression 14.

Surrounding the region in which the rivets 16 are located is a circular line of weakness 18. At diameterally opposed locations on the circular line of weakness 18 are two pairs of straight lines of weakness 20, extending inwardly from the circular line of weakness 18. The wall 12 also supports two alignment posts 22 spaced from the depression 14 on opposite sides thereof, and aligned along a diameter of the circular line of weakness 18, the latter diameter being at right angles to the diameter along which the depression 14 is aligned.

The wall 12 external to the circular line of weakness 18 is stamped to provide a ledge 24 which completely surrounds the circular line of weakness 18 and is generally circular although includes outwardly projecting obtuse angled portions 26 at locations aligned with the depression 14. At the two locations 90° around from the obtuse angled portions 26 are located two shelf-like portions 28, these being aligned directly outwardly of the straight lines of weakness 20.

The ledge is formed such as to have an inwardly overhanging upper lip 29, the purpose for which will be evident from what follows.

Figure 2:
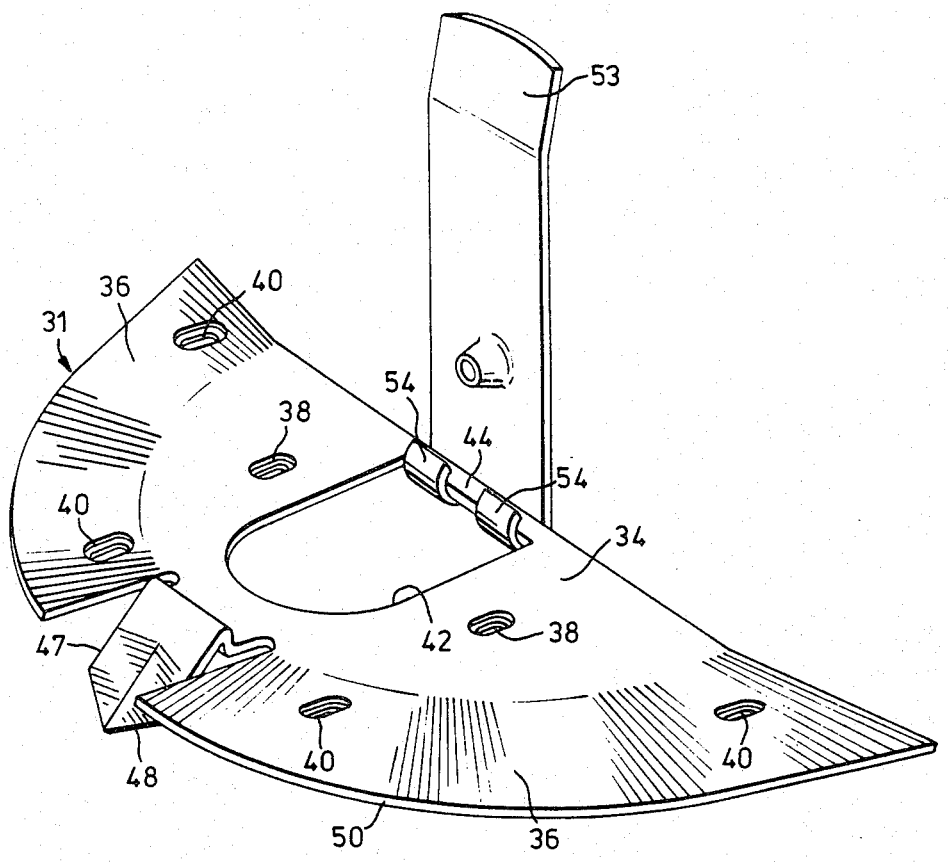
FIG. 2 is a perspective view of the plate component of this invention.

Attention is now directed to FIG. 2 which shows one of two plates 31, the other plate 32 being shown in FIG. 1. Returning to FIG. 2, the plate 31 is seen to include a central substantially flat portion 34 and an upwardly dished resilient portion 36. The flat portion 34 has two elongated openings 38 which are stepped in such a way that they have a smaller dimension at the bottom than at the top. Similar openings 40 are found in the portion 36. An aperture 42 is cut from the central part of the flat portion 34, in such a way as to leave a cross bar 44.

Integral with the plate 31 is a punch 47 having a piercing edge 48. FIG. 2 shows the punch 47 in its unstressed, "at-rest" position. However, the punch is resilient, and can resiliently be moved to the position shown in FIG. 1 at the left, in which its major extent lies in a plane approximately parallel to that of the wall 12. In that position, shown at the left of FIG. 1, the punch 47 seeks always to return to the position shown in FIG. 2, but is prevented from doing so in FIG. 1 by the fact that the leftward extremity of the punch 47 rests on the shelf-like portion 28.

As further seen in FIG. 1, the rivets 16 extend through the openings 38 and 40, and have enlarged upper ends so that they retain the plate 31 in position against the wall 12. Likewise, in the position shown in FIG. 1, the plate 31, which has a substantially circular outer edge 50, has that outer edge 50 lodged beneath and retained in gripping relation by the overhanging lip 29 of the ledge 24.

Returning to FIG. 2, the other operative component in the Figure is a lever 53 having a hinged knuckle 54 that encircles the cross bar 44 and thus provides a hinged connection between the lever 53 and the plate 31.

As can be seen in FIG. 1 at the right, the lever 53 also has a projection 56 adapted to engage in the depression 14 as the lever 53 is rotated about its attachment to its respective plate (32 in FIG. 1). It can be further seen in FIG. 1 that the rightward end of the lever, i.e. the portion extending rightwardly from the hinge-knuckle attachment 54, is substantially longer than the projection 56, thereby allowing a substantial mechanical advantage in the "prying" operation which will shortly be described. Before describing this operation, it will be noted that each lever 53 has a deformed conical seat 60 which is adapted to register with a respective conical projection 22, when the lever 53 is in its position parallel with the wall 12, as is the lever 53 to the right in FIG. 1.

To operate the mechanism in such a way as to open the end wall 12 of the container 10, the two levers 53 are first raised to the position shown for the leftward lever 53 in FIG. 1, at which point the uppermost ends will still be spaced apart by about one inch. No movement of the plates 31, 32 will take place during this initial movement of the levers 53. When the levers are in this initial position (shown for the leftward lever in FIG. 1), the projection 56 will engage the side wall of the depression 14, and restrain further arcing movement of the levers 53. However, by the application of minimal squeezing force between the two ends of the levers 53, a levering action will take place allowing the levers 53 to be squeezed together into contact, and at the same time pulling both of the plates 31, 32 toward each other. This action initiates two automatic functions: the first function is that the two punches 47 slip inwardly off the respective shelf-like portions, and immediately thrust downwardly with their piercing edges 48 against the respective region of the circular line of weakness 18. This will cause the line of weakness to rupture, and also the straight lines of weakness 20. At the same time, the inward motion of each plate 31, 32 will withdraw the edges of that plate from under the retaining lip 29 of the ledge 24, thus freeing the normally dished portion 36 of the plate 31 to pull upwardly on the wall 12 by virtue of the retaining action of the rivets 16. This will continue the rupture of the circular line of weakness 18, and very quickly will cause the entire central disc defined by the circular line of weakness to come away from the remainder of the wall 12.

While one embodiment of this invention has been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. In combination:

a container body including a wall intended to be opened, a slidable plate juxtaposed against said wall externally of the container body, retention means retaining said plate against said wall while permitting relative sliding between them, a resilient punch supported by the plate and having a piercing edge biased toward the wall, the punch resting on a shelf-like portion of the wall in biased condition, the wall having a region of weakness adjacent the said shelf-like portion such that if the plate slides away from the shelf-like portion thus drawing the punch off the portion, the piercing edge of the punch can strike the region of weakness and rupture the same, and means for causing the plate to slide away from said shelf-like portion.

2. The combination claimed in claim 1, in which said means for causing the plate to slide is a lever arranged such as to require a smaller force than would be required to push directly on the plate.

3. The combination claimed in claim 1, in which the wall has a depression, said means for causing the plate to slide being a lever having a hinge-knuckle attachment to said plate, the lever having a projection adapted to engage in said depression as the lever is rotated about the said attachment, the lever having an end remote from and longer than said projection, whereby the end can be raised to cause the projection to engage in the depression and with a substantial mechanical advantage urge the plate to slide away from the shelf-like portion.

4. The combination claimed in claim 3, in which the container body is cylindrical, and in which the wall is a circular end thereof.

5. The combination claimed in claim 3, in which the slidable plate has a plurality of distributed, elongated apertures, and in which the said retention means includes rivet members on the wall which project through said elongated apertures, the rivet members having enlarged ends for retaining the plate in place against the wall.

6. The combination claimed in claim 5, in which the plate has substantially the shape of a segment of a circle, and in which said wall incorporates a curvilinear ledge adapted to engage over the marginal curved portion of the plate when the punch rests on the shelf-like portion, the wall having a line of weakness inwardly adjacent said ledge, the plate being resiliently sprung from an upwardly-dished, "at-rest" position to a substantially flat position for lying against said wall, whereby as soon as the punch punctures the region of weakness, the plate is released by said ledge and can curl upwardly and thus sever the wall further along the said line of weakness.

7. The combination claimed in claim 6, in which there are two plates each as defined therein, and in which the two levers are situated so as to be raised toward each other, whereby they can be pinched between thumb and forefinger to effect rupture of said wall.

8. The combination claimed in claim 7, in which the line of weakness for each plate is part of a substantially circular line of weakness, and in which the said region of weakness for each plate is also a part of the circular line of weakness, and in addition includes two spaced-apart straight lines of weakness extending inwardly from the circular line of weakness on either side of the respective punch.

* * * * *